US007026857B2

(12) United States Patent
Trankle

(10) Patent No.: US 7,026,857 B2
(45) Date of Patent: Apr. 11, 2006

(54) MULTIPLIER CIRCUIT

(75) Inventor: Gunther Trankle, Neu-Ulm (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/484,010

(22) PCT Filed: Jul. 10, 2002

(86) PCT No.: PCT/DE02/02525

§ 371 (c)(1),
(2), (4) Date: Jan. 15, 2004

(87) PCT Pub. No.: WO03/009078

PCT Pub. Date: Jan. 30, 2003

(65) Prior Publication Data

US 2004/0155694 A1 Aug. 12, 2004

(30) Foreign Application Priority Data

Jul. 17, 2001 (DE) ..... 101 34 754

(51) Int. Cl.
*G06G 7/16* (2006.01)

(52) U.S. Cl. ..... 327/359; 455/326

(58) Field of Classification Search ..... 327/356–359; 455/326, 333

See application file for complete search history.

(56) References Cited

U.S. PATENT DOCUMENTS

| | | | | |
|---|---|---|---|---|
| 3,887,886 | A | 6/1975 | Okada et al. | |
| 5,379,457 | A * | 1/1995 | Nguyen | 455/323 |
| 5,715,532 | A | 2/1998 | Sagawa et al. | |
| 6,456,144 | B1 * | 9/2002 | Catala | 327/359 |

FOREIGN PATENT DOCUMENTS

| | | |
|---|---|---|
| DE | 2365059 C2 | 8/1974 |
| DE | 3840855 C2 | 6/1990 |
| DE | 4420377 A1 | 3/1995 |
| GB | 2282288 A | 3/1995 |
| GB | 2282289 A | 3/1995 |
| GB | 2283627 A | 5/1995 |
| GB | 2310941 A | 9/1997 |

OTHER PUBLICATIONS

English language abstract of DE 3840855 C2.
Gilbert, B.: "A Precise Four-Quadrant Multiplier with Subnanosecond Response"; IEEE Journal of Solid-State Circuits (1968), SC—3.4 Dec. 1968, pp. 365-373.
Gray, Meyer: "Analysis and Design of Analog Integrated Circuits", John Wiley & Sons, Third Edition 1993, ISBN 0-471-57495-3; Fig. 10.9 (1 page).

* cited by examiner

*Primary Examiner*—Kenneth B. Wells
(74) *Attorney, Agent, or Firm*—Eschweiler & Associates, LLC

(57) ABSTRACT

A multiplier circuit includes a multiplier core with two cross-coupled transistor pairs. First and second signal sources are respectively driven by first and second signals to be multiplied, and are connected to control inputs of the transistors of the multiplier core for diversion between the transistor pairs and between the transistors of the pairs.

22 Claims, 7 Drawing Sheets

$\varphi(IS1) = \varphi(IS1')$ $\overline{\varphi(IS1)} = \overline{\varphi(IS1')}$ $A(IS1) = A(IS1')$ $\overline{A(IS1)} = \overline{A(IS1')}$ $\varphi(IS2) = \varphi(IS2')$ $\overline{\varphi(IS2)} = \overline{\varphi(IS2')}$ $A(IS2) = A(IS2')$ $\overline{A(IS2)} = \overline{A(IS2')}$

MULTIPLIER CIRCUIT

FIELD OF THE INVENTION

The present invention relates to a multiplier circuit.

BACKGROUND OF THE INVENTION

Analog multiplier circuits are used, for example in mass products of mobile radio, such as mobile telephones. They usually contain, both in the transmitting and in the receiving direction, an analog circuit which comprises all required circuit components for coupling the digital signal processing circuits to a radio interface. Depending on the modulation method, a carrier signal is modulated in the transmitting direction, and in the receiving direction, a received radio-frequency signal is combined with a heterodyne signal and translated into a low-frequency signal.

For the frequency conversion both in the transmitting direction and in the receiving direction, analog multiplier circuits are used in a so-called mixer mode. Further examples of applications for analog multiplier circuits are found in the splitting of the signals into a complex-valued signal with an in-phase component and a quadrature component normally used in modern mobile radio transmitters and receivers. This requires heterodyne or carrier signals which can be supplied to the multipliers, with a signal pair which has a precise phase displacement of 90° with respect to one another. Multiplier circuits, particularly those with similar signal inputs such as, for example, passive ring mixers, allow the phase displacement of 90° to be monitored in a particularly precise manner.

In the document Gray, Meyer: Analysis and Design of Analog Integrated Circuits, John Wiley & Sons, Third Edition 1993, ISBN 0-471-57495-3, a Gilbert multiplier cell constructed in bipolar circuit technology is specified in FIG. 10.9. This multiplier of the Gilbert type is an active multiplier which, however, has the disadvantage that the two signal inputs for supplying the signals to be multiplied are not electrically equivalent.

Such electrically non-equivalent signal inputs are shown, for example, in the document DE 236 50 59, compare there, for example, the interconnection of the signal sources V1, V2 with the differential amplifiers in FIG. 1. Both signal sources are coupled to the base terminals of the differential amplifiers via respective transistors. In this arrangement, however, the transistors allocated to source V2 are connected directly to the supply potential, whereas the transistors allocated to source V1 are connected to ground via resistors and a current source. Accordingly, a push-pull modulator with electrically non-equivalent signal inputs is shown.

Analog multiplier circuits in the fields of application supplied are subject to demands for ever lower supply voltage, little space requirement and producibility in inexpensive monolithic integration.

When the analog multipliers are used as frequency converters, that is to say as radio-frequency mixers, good linearity, little noise and high mixer gain is additionally required apart from the above-mentioned characteristics.

It is the object of the present invention to specify a multiplier circuit which, with high accuracy, can be used for monitoring the 90° phase difference of radio frequency signals.

SUMMARY OF THE INVENTION

According to the invention, the object is achieved by a multiplier circuit having a multiplier core with two cross-coupled transistor pairs, a first signal source to which a first signal to be multiplied can be supplied, with an output which is connected to control inputs of the multiplier core and with a first source impedance, and a second signal source to which a second signal to be multiplied can be supplied, with an output which is connected to control inputs of the multiplier core and with a second source impedance which is equal to the first source impedance.

According to the present principle, a wide-band analog multiplier with two electrically equivalent inputs is provided.

The four-quadrant multiplier circuit specified has two inputs for supplying in each case one signal to be multiplied which have equal electrical characteristics due to the equal source impedances of the signal sources.

The control inputs of the multiplier core are preferably the control inputs of the transistors which form the two cross-coupled transistor pairs.

Due to the equivalence of the two signal inputs of the present multiplier circuit, which form the basis of the present principle, this multiplier circuit can be used, in particular for precise analog multiplier functions and for a wide-band phase/frequency modulator and demodulator circuits. In addition, the present multiplier circuit enables the 90° phase displacement of local oscillator signals in mobile radio transceivers to be precisely monitored.

Since the present multiplier circuit can be built up with a low number of transistor levels, it can be used for operating voltages of <2.5 V.

In the present principle, the voltage/current control used in the conventional Gilbert multiplier circuits is replaced by a controlling both input gates with super-imposed voltage sources. Each signal source is controlled here with in each case one current source, both sources having the same source impedance and thus being electrically equivalent.

In this arrangement, the superimposition of the signal sources at the control inputs of the multiplier core, as summation of two currents at a source impedance, is equivalent to the summation of two voltage sources with an effective source impedance.

Driving the multiplier core with the two cross-coupled transistor pairs which are advantageously interconnected as differential amplifiers which are cross-coupled, is effected via the common-mode input signal of the respective transistor pair for a first input signal and via the in each case differential drive to the two transistor pairs for a second input signal.

Accordingly, the common-mode drive of the transistor pairs is not effected via the common emitter junction and its common-mode drive as in the Gilbert cell, but the drive with the two input signals is applied to the control inputs of the transistors so that equal source impedances and thus equal electrical characteristics of the two inputs can be achieved.

The present multiplier circuit thus combines the advantages of an active Gilbert multiplier cell, namely the capability for monolithic integration, with the advantages of the passive ring mixer circuit, namely the high electrical symmetry of the two inputs.

In an advantageous further development of the invention, the multiplier core comprises a first and a second transistor pair which are interconnected with one another in a cross coupling. The transistor pairs in each case comprise a first and a second transistor having in each case one control input. Furthermore, the signal sources drivet the multiplier core at the control inputs of the transistors in such a manner that a diversion between the first and the second transistor pair is effected with the first signal to be multiplied and a diversion between the first and the second transistor is in each case effected in both transistor pairs with the second signal to be multiplied.

Compared with the conventional Gilbert cell in which the diversion also takes place differentially via the control inputs of the transistors with the second signal to be multiplied, this diversion is also achieved with the common-mode level of the transistor pairs between the first and second transistor pair by driving the control inputs of the transistors in the present multiplier circuit whereas, in the conventional Gilbert cell this control is achieved via voltage/current conversion and the feed currents for the differential amplifiers. With the present principle, however, the desired electrical equivalence of the signal sources is possible due to the similarity of their source impedances.

In a further preferred embodiment of the present invention, the first signal source is coupled to the multiplier core for supplying the signal in such a manner that the control inputs of the first and second transistor of the first transistor pair are supplied with the first signal to be multiplied unchanged and the control inputs of the first and second transistor of the second transistor pair are supplied with the first signal to be multiplied inverted, and in that the control inputs of the first transistors of the first and second transistor pair are supplied with the second signal to be multiplied unchanged and the control inputs of the second transistors of the first and second transistor pair are supplied with the second signal to be multiplied inverted.

With the connection to their control inputs as described, the transistor pairs of the multiplier core, which are constructed as differential amplifiers, can be driven differentially in a simple manner by means of the signals to be multiplied, which are usually present as balanced signals in any case, the input signals supplied by the first and second signal sources becoming superimposed in accordance with the present principle.

In a further preferred embodiment of the present invention, the control terminals of the transistors of the transistor pairs of the multiplier core are their base or gate terminals.

In a further preferred embodiment of the present invention, the emitter or source terminals of the first and second transistors are in each case connected to one another for forming one transistor pair each.

To form a differential amplifier, emitter and source terminals of two transistors are coupled to one another and to a supply or reference potential connection via a current source. In the present multiplier circuit, this coupling is done preferably via a constant-current source. Furthermore, this coupling is done either directly or via feedback resistors depending on the desired linearity characteristics and the application of the electrical multiplication.

In a further preferred embodiment of the present invention, the first and second signal source in each case comprise a differential amplifier having two inputs each for supplying the signals to be multiplied and four outputs for connection to the control inputs of the transistors.

The two inputs of the differential amplifiers in each case form a balanced signal input for supplying the signal to be multiplied as a differential signal.

For providing the heterodyne signals required for driving the multiplier core, the outputs of the differential amplifiers are constructed with in each case four outputs, that is to say with two balanced output terminal pairs, with in each case two inverting terminals and two non-inverting terminals.

In a further preferred embodiment of the present invention, the differential amplifier of the first signal source is coupled to a supply potential connection and the differential amplifier of the second signal source is coupled to a reference potential connection. To feed the differential amplifiers, they can either be both coupled to one reference potential connection, for example, ground, or both coupled to a supply potential connection or, as described, and preferably provided in the radio-frequency application of the multiplier as mixer, in each case one of the differential amplifiers for providing the first and second signal source can be coupled to the supply or to the reference potential connection. The outputs, for example, the collector terminals of the signal source differential amplifiers are connected to the control inputs of the multiplier core.

The division into equal signal currents for the first signal source and into equal signal currents for the second signal source can be achieved preferably in transistors with equal area or additionally with feedback resistors between the emitter terminals of the paired transistors of the signal source differential amplifiers and a connected current source.

In a further preferred embodiment of the present invention, the first and second signal source are constructed as voltage/current converters.

The signals to be multiplied are usually present as voltage signals whereas the actual multiplier core can be advantageously driven via current signals. For this reason, the construction of the signal sources as voltage/current converters described is advantageous.

BRIEF DESCRIPTION OF THE DRAWINGS

As described in the text which follows, the invention will be explained in greater detail with reference to a number of exemplary embodiments which are shown in the drawings, in which.

DETAILED DESCRIPTION

Figure 1:
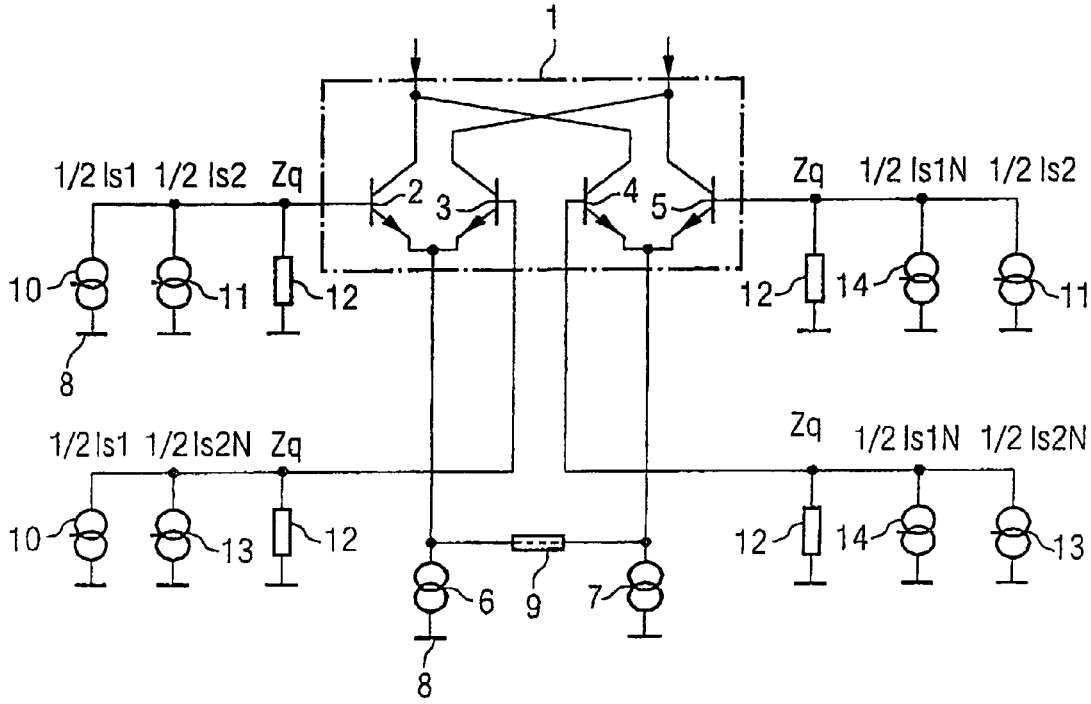
FIG. 1 shows the principle of the present multiplier circuit by means of a simplified equivalent circuit of an example where first and second signal source are shown as current sources.

The reference symbols in the drawings are:

1 Multiplier core

2 Transistor

3 Transistor
4 Transistor
5 Transistor
6 Current source
7 Current source
8 Reference potential connection
9 Resistor
10 Current source
11 Current source
12 Source impedance
13 Current source
14 Current source
15 Current source
16 Source impedance
17 Voltage source
18 Current source
19 Resistor
20 Resistor
21 Supply potential connection
22 Output
23 Collector resistor
24 Transistor
25 Transistor
26 Transistor
27 Transistor
28 Resistor
29 Current source
30 Transistor
31 Transistor
32 Resistor
33 Diode
34 Transistor
35 Transistor
36 Voltage source
37 Transistor
38 Transistor
39 Transistor
40 Transistor
41 Resistor
42 Resistor
43 Current source.

The multiplier core of the present multiplier circuit which is provided with the reference symbol 1 comprises two bipolar transistor pairs interconnected as differential amplifiers, a first transistor pair comprising a first transistor 2 and a second transistor 3 and a second transistor pair comprising a first transistor 4 and a second transistor 5. The first transistor pair 2, 3 and second transistor pair 4, 5 are interconnected with one another in a cross coupling. For this purpose, the two collector terminals of the first transistors 2, 4 and the collector terminals of the second transistors 3, 5 are in each case connected directly to one another. Furthermore, the emitter terminals of the transistors 2, 3 and the transistors 4, 5 which form the first and second transistor pair, respectively, are directly connected to one another for forming the differential amplifiers. A first and a second signal to be multiplied are coupled to the control terminals, constructed as base terminals, of the transistors 2 to 5. The common emitter junctions of the transistor pairs 2, 3; 4, 5 are connected to a reference potential connection 8 via one current source 6, 7 in each case. Furthermore, a feedback resistor 9 is provided which connects the two emitter junctions of the transistor pairs 2, 3; 4, 5 to one another. This feedback resistor 9 can be omitted in alternative embodiments.

First and second signal sources for driving the multiplier core 1 via the control inputs of the transistors 2 to 5 with the first and second signal to be multiplied are shown as current sources 10, 11, 13, 14 with parallel impedance 12 in the simplified circuit according to FIG. 1. In detail, a controlled current source 10, representing the first signal to be multiplied is connected to the control input, that is to say the base terminal of the first transistor 2 of the first transistor pair 2, 3 with respect to reference potential connection 8. In parallel with the current source 10, a further current source 11 is connected which represents the second signal to be multiplied. A resistor which is connected in parallel with the current sources 10, 11 is provided as source impedance 12.

Analogous to the equivalent current source 10, 11, 12, a parallel circuit of two current sources and a source impedance 12 is also connected to each further control input of the transistors 3, 4, 5 of the multiplier core. In this arrangement, the source impedance 12, according to the principle of the present invention, is equal in order to provide balanced input gates for all control inputs of the transistors of the multiplier core 1. The current sources connected to the control input of the second transistor 3 of the first transistor pair 2, 3 again represent on the one hand, the first signal to be multiplied and, on the other hand, the inverted second signal to be multiplied and are accordingly designated by the reference symbol 10 and 13.

The control terminal of the first transistor 4 of the second transistor pair 4, 5 is connected with respect to reference potential 8 with the source impedance 12 and a current source 14 connected in parallel therewith and a current source 13 also connected in parallel. Whereas the current source 14 represents the inverted signal derived from the first signal to be multiplied, the current source 13, as mentioned above, provides an inverted second signal to be multiplied of the multiplier.

Finally, current sources 14, 11 and source impedance 12 are connected in a parallel circuit to the control input of the second transistor 5 of the second transistor pair 4, 5, the current sources 14, 13 providing the signal derived from the first signal to be multiplied in inverted manner and the signal derived from the second signal to be multiplied in non-inverted manner.

Accordingly, the first signal source of the present multiplier comprises the current sources 10, 14 whilst the second signal source comprises the current sources 11, 13.

By means of the first current $Is_1$ derived from the first signal to be multiplied, which is provided non-inverted by the current sources 10 and inverted by the current sources 14, a diversion is achieved between the first differential amplifier 2, 3 and a second differential amplifier 4, 5. In conventional multipliers, this diversion is normally achieved via their common-mode signal present at the emitter junction. In the present principle, in contrast, these common-mode drives of the differential amplifiers 2, 3; 4, 5 are coupled in via their base terminals. As a result, it is possible to provide in each case equal source impedances 12 at the first and second signal source by superimposing the first and second signal to be multiplied on the current drive of the transistors. By means of the current derived from the second signal to be multiplied, which is provided non-inverted by the current sources 11 and inverted by the current sources 13, the differential drive for the two transistor pairs 2, 3; 4, 5 is in each case effected between the first transistor 2, 4 and the second transistor 3, 5 as in conventional multipliers.

Due to the good symmetry characteristics of the first and second input of the multiplier according to FIG. 1, it can preferably be used for monitoring the precise phase difference of 90° in local oscillator signals and as a radio-frequency mixer.

FIG. 2 shows the familiar conversion of a current source with parallel impedance into an equivalent voltage source with series impedance. A current source 15 with a short-circuit current $I_k$ and parallel-connected source impedance 16 is electrically equivalent to a voltage source 17 with a no-load voltage $U_L$ and a series impedance 16. Accordingly, the representations of the signal sources 10 to 14 according to FIG. 1, which are drawn as current sources for better clarity and for easier understanding, can be converted in a simple manner into voltage sources which have equivalent electrical characteristics, according to FIG. 2. Ohm's Law can be used for converting between short-circuit current, no-load voltage and source impedance.

Figure 2A:
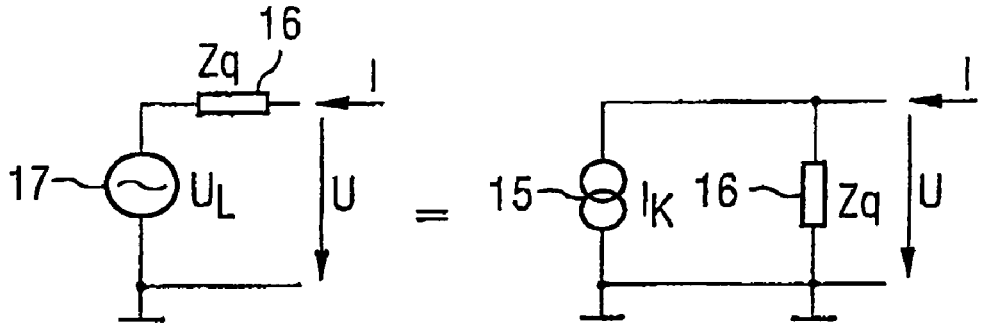
FIG. 2*a* shows the known equivalence of current and voltage sources, taking into consideration the source impedance.
Figure 2B:
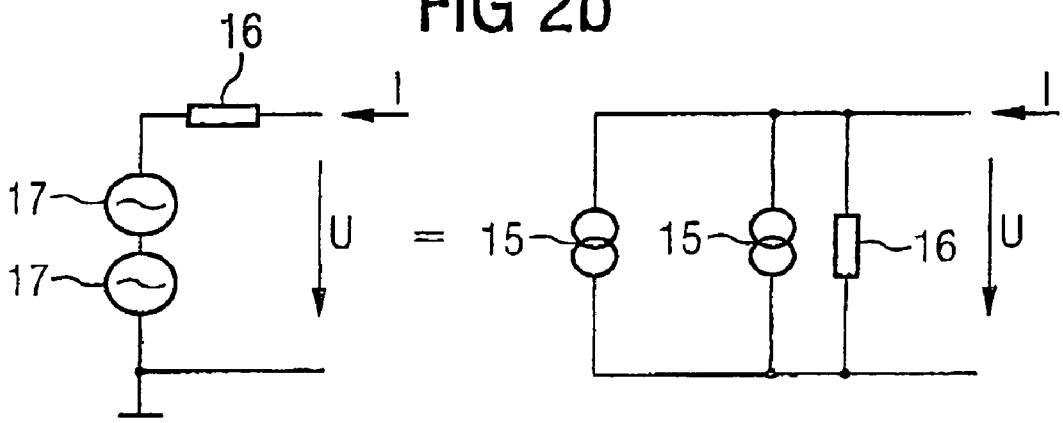
FIG. 2*b* shows a further development of the principle of FIG. 2*a* with in each case two superimposed current or voltage sources, respectively.

FIG. 2*b* shows a development of the principle of FIG. 2*a* applied to two superimposed current or voltage sources, respectively. In this arrangement, a parallel circuit of two current sources 15 with a similar parallel connected source impedance 16 is electrically equivalent to a series circuit of two voltage sources 17 with a series impedance 16.

Accordingly, applied to the principle of FIG. 1, the parallel-connected superimposed current sources 10, 11, 13, 14 can be replaced by a series circuit of two superimposed and in each case controlled voltage sources with series impedance within the scope of the invention.

Figure 3:
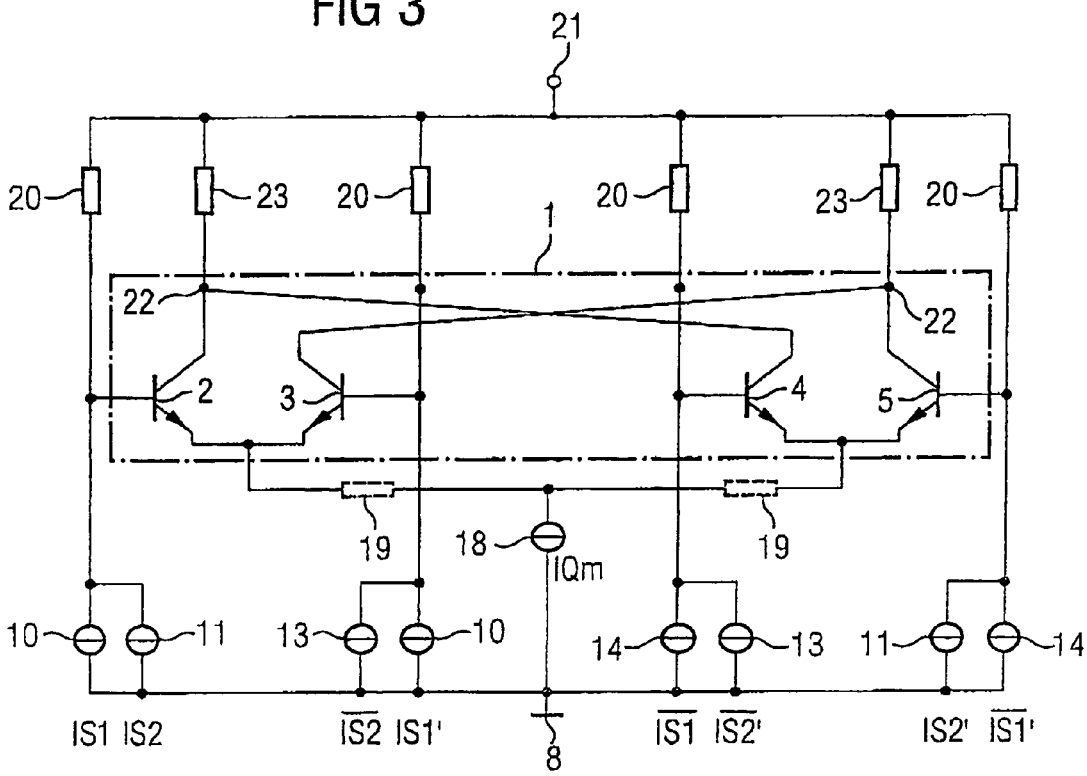
FIG. 3 shows a further exemplary embodiment of the multiplier circuit with reference to a further development of FIG. 1.

FIG. 3 shows an exemplary embodiment of a multiplier circuit according to the invention in a development of the circuit according to FIG. 1. The multiplier core 1 with the transistor pairs 2, 3; 4, 5 corresponds to that of FIG. 1 in its configuration and operation and, therefore, will not be described once more here. To feed the differential amplifiers 2, 3; 4, 5 of the multiplier core 1, a current source 18 is provided which is coupled via, in each case, one resistor 19 to the emitter junction of the differential amplifiers 2, 3; 4, 5 and to a reference potential connection 8.

To feed the current sources 10, 11, 13, 14, which, as described for FIG. 1, provide first and second signal source for supplying the first and second signals to be multiplied, in each case a resistor 20 is connected between control input of the transistors 2, 3, 4, 5 and a supply potential connection 21. To ensure the equality of the source impedances provided in accordance with the present principle, all resistors 20 have the same resistance value.

As in the multiplier circuit according to FIG. 1, a balanced output of the multiplier circuit at the cross-coupled collector outputs of the transistor pairs 2, 3; 4, 5 is formed and identified by the reference symbol 22. This multiplier output 22 is connected to the supply potential connection 21 via in each case one further resistor 23. The operation of the circuit according to FIG. 3 corresponds to that of FIG. 1 and therefore will not be repeated again. To achieve the described diversion of the multiplier core by means of the first and second signal source as described in FIG. 1, the conditions specified at the bottom of FIG. 3 must be met, that is to say, signal sources $Is_1$, $Is_1'$; Is2, Is2', $Is_1$\, $Is_1$\' and Is2\, Is2\' are in each case equal in amplitude A and phase angle $\phi$.

Figure 4:
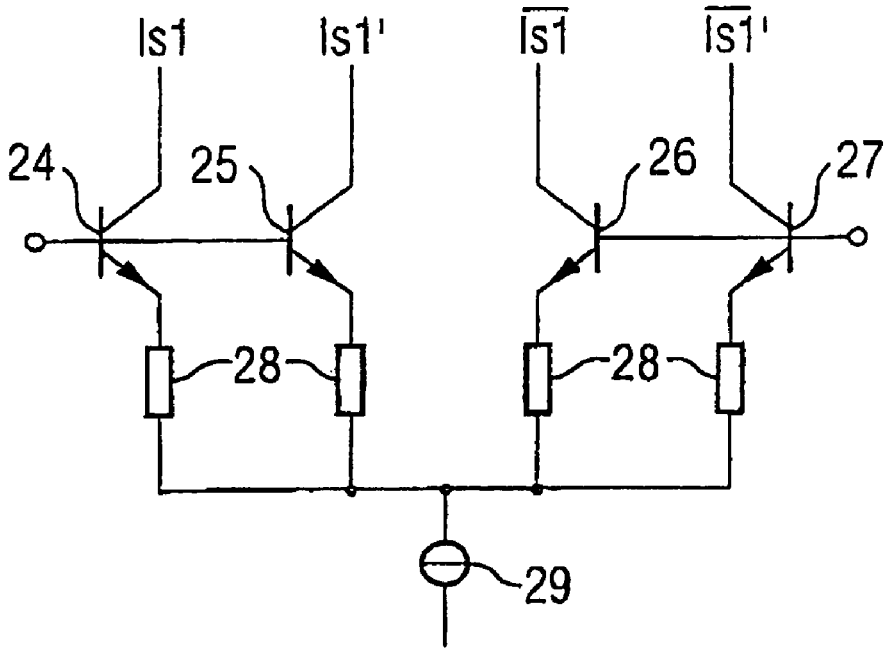
FIG. 4 shows a first exemplary implementation of a signal source for application in a multiplier circuit according to FIG. 3.
Figure 5:
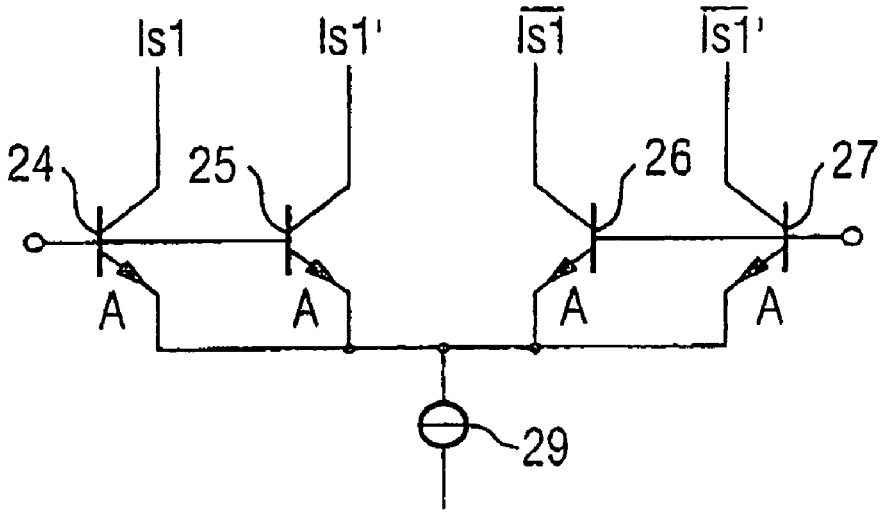
FIG. 5 shows a second exemplary implementation of a signal source for application in a multiplier circuit according to FIG. 3.

FIG. 4 and FIG. 5 in each case show examples of possible implementations for the current sources 10, 11, 13, 14, that is to say for forming the first and second signal sources.

FIG. 4 shows an example of the first signal source 10, 14 which, however, can also be correspondingly used as second signal source 11, 13. In detail, FIG. 4 shows a differential amplifier with in each case duplicated transistors 24, 25; 26, 27 which are connected in parallel at their inputs. The first signal to be multiplied can be applied as a balanced signal to base terminals of transistors 24, 25, 26, 27. To form a differential amplifier, the emitter terminals of the bipolar transistors 24 to 27 are connected via in each case one emitter resistor 28 to a common emitter junction which can be connected to a reference potential connection 8 via a current source 29. The collector terminals form current outputs of the transistors, wherein the collector terminal of transistor 24 provides current source output $Is_1$, the collector terminal of transistor 25 provides the electrically equivalent current output Is1' and complementary, that is to say inverted current outputs IS1\ and equivalent IS1\' are provided by the collector terminals of the npn bipolar transistors 26, 27. Since the emitter resistors 28 all have the same resistance value and this source impedance can be used both for the first signal source and the second signal source, both of which can be implemented by means of a circuit according to FIG. 4, the symmetrical characteristics of the input gates of the circuit, which form the basis of the present principle, can be achieved.

The emitter resistors 28 according to FIG. 4 promote the precise halving of the current to the current outputs IS1, IS1'.

FIG. 5 shows a further exemplary embodiment of the first and second signal source which can be used as an exemplary alternative to a signal sources according to FIG. 4 for forming the signal sources 10, 11, 13, 14 according to FIG. 3. In this arrangement, for forming a differential amplifier as in FIG. 4, two npn bipolar transistors 24, 25, 26, 27 are in each case coupled to one another at the emitter end and to a reference or supply potential connection via a current source 29. At the base of transistors 24 to 27, a first or second signal to be multiplied, can be supplied in each case as a balanced signal. Compared with FIG. 4, however, the emitter resistors 28 can be omitted in the embodiment of the signal source differential amplifier according to FIG. 5. To provide the required symmetry, the integrated transistors 24 to 27 have identical emitter areas A.

Figure 6:
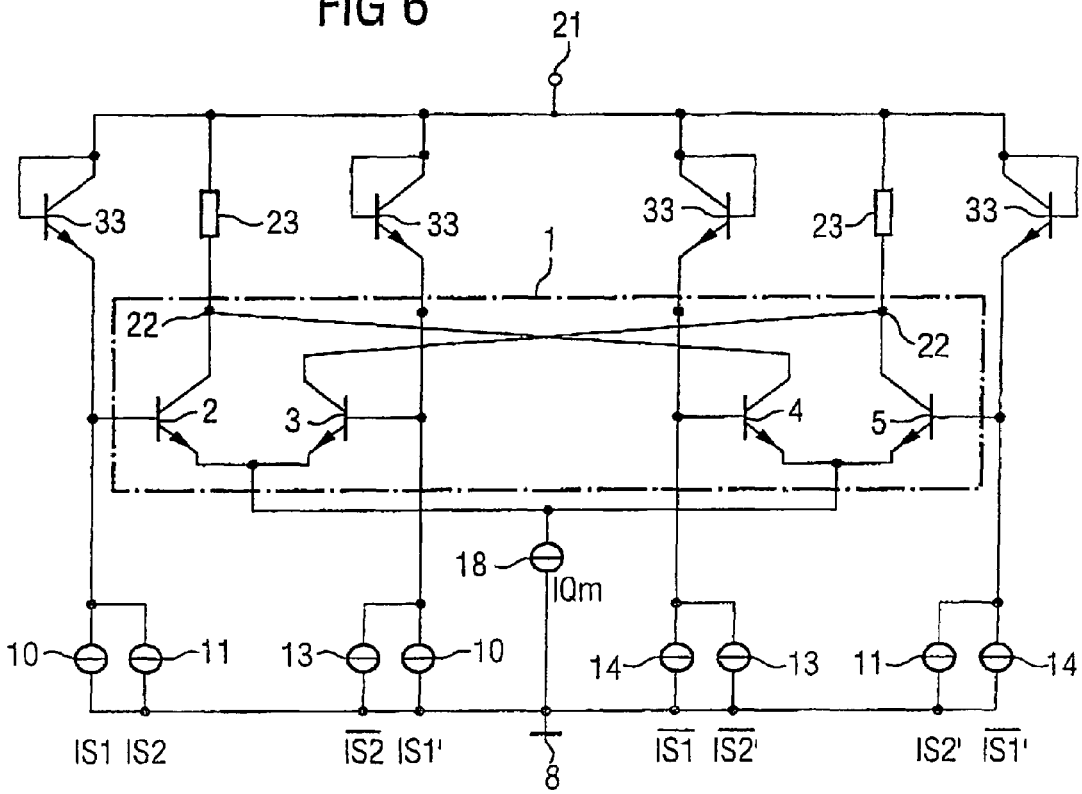
FIG. 6 shows a further exemplary embodiment of the multiplier circuit with reference to a development of the circuit according to FIG. 1.

FIG. 6 shows a further embodiment of a multiplier circuit in an alternative embodiment according to FIG. 3. In this arrangement, the structure and operation of the circuit according to FIG. 6 largely corresponds to the circuit according to FIG. 3. The only differences consist in the missing emitter resistors 19 and in the current source resistors 20 being replaced by transistor diodes 33. Accordingly, diode-connected transistors 33 are in each case connected between supply potential connection 21 and control inputs of the multiplier core transistors 2 to 5 and current source outputs 10, 11, 13, 14 respectively. The diodes 33 form a logarithmic load for linearizing the tanh characteristic when no emitter resistors are provided at the emitter junctions of transistor pairs 2, 3; 4, 5.

Figure 7:
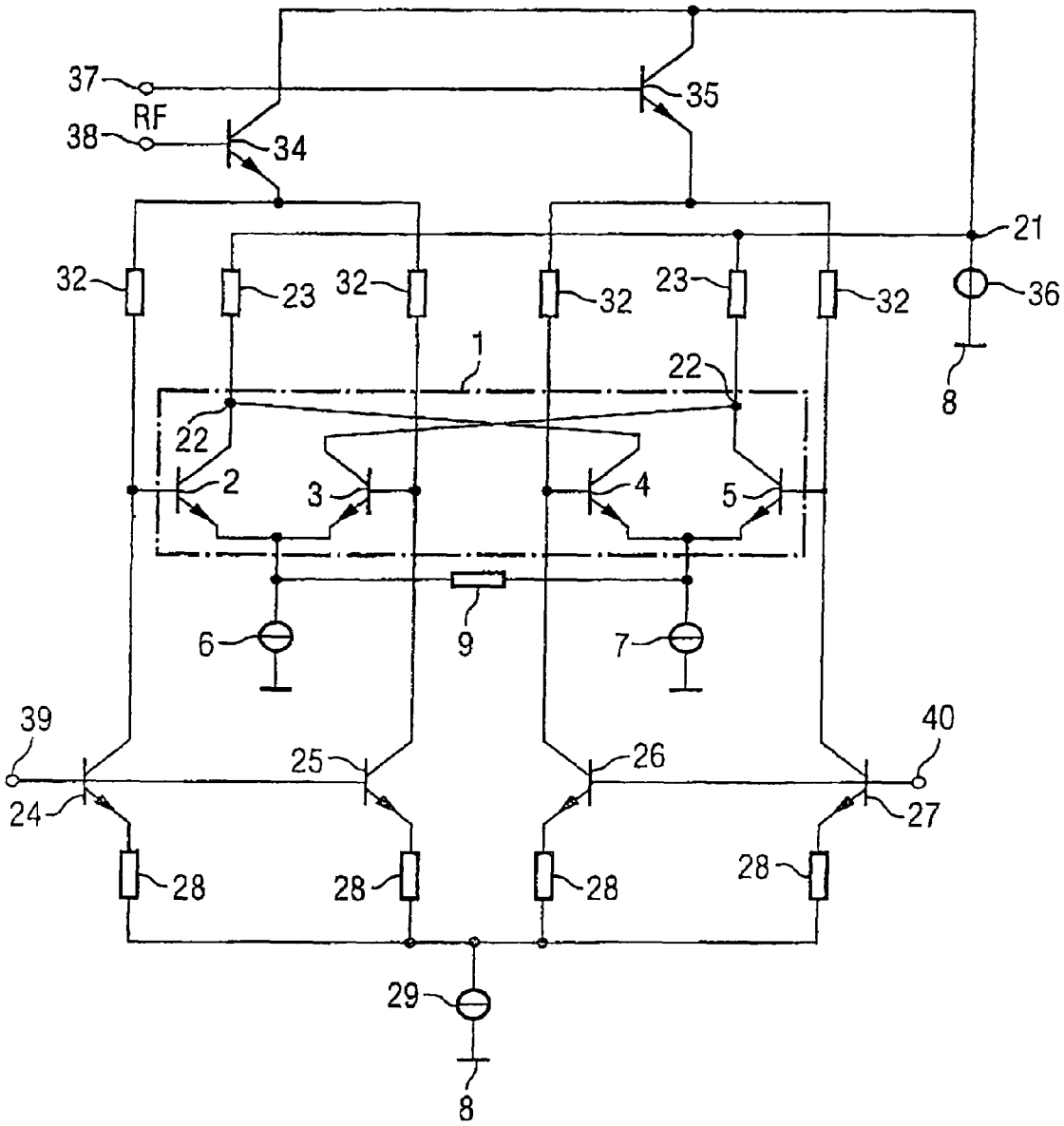
FIG. 7 shows a development of the multiplier circuit according to FIG. 1 applied to a radio-frequency mixer.

FIG. 7 shows a further exemplary embodiment of a multiplier circuit according to the present principle, which is developed as a radio-frequency mixer circuit on the basis of the multiplier circuit according to FIG. 1.

The structure and operation of the multiplier core 1 of the circuit according to FIG. 7 corresponds to that previously explained and will not be discussed again at this point. Similarly, the emitter current supply with feedback resistor 9 has already been described in FIG. 1 and, therefore also will not be repeated again at this point. The special feature of the multiplier circuit according to FIG. 7 lies in the distribution of the differential amplifiers 34, 35; 24 to 27 forming the first and second signal source, on the one hand at the supply potential end and, on the other hand, at the reference potential end. The first signal source 34, 35 with its associated collector resistors 32 here corresponds to an emitter-follower circuit. The structure and operation of the second signal source 24 to 27 with the emitter resistors 28 corresponds to the signal source according to FIG. 4. By means of the first signal input 37, 38, which is constructed as a radio-frequency output, a diversion from the first differential amplifier 2, 3 to the second differential amplifier 4, 5 is effected. For this purpose, the input terminals 37, 38 are coupled to the base terminals of the transistors 34, 35, the collector terminals of which are connected to one another and to the supply potential connection 21. The supply potential connection 21 is connected to reference potential 8 via a voltage source 36. The emitter terminal of the transistor 34 is connected via in each case one resistor 32 to the control inputs of the transistors of the first transistor pair 2, 3; and the emitter terminal of transistor 35 is connected via in each case a similar resistor 32 to the two control inputs of the second differential amplifier 4, 5 of the multiplier core 1.

To divert between first and second transistors 2, 4; 3, 5, in each case within the transistor pairs, transistors 24 to 27 are connected at their collectors to transistor pairs 2, 5 and 3, 4, respectively according to the present principle. At the emitter end, transistors 24 to 27 of the second signal source are connected via in each case one emitter resistor 28 to a common emitter junction and also to the reference potential connection 8 via a current source 29, whereas a second signal input 39, 40 which can be supplied with a second signal to be multiplied, is coupled to in each case one base terminal of transistors 24 to 27.

In the present case, the multiplier is designed as receiving demodulator which can be supplied at its first input terminal pair 37, 38 with a radio-frequency signal RF, coupled in from an antenna and can be supplied at its second input terminal pair 39, 40 with a differential local oscillator signal LO as heterodyne signal. At output 22 of the multiplier core 1, a down-converted or demodulated useful signal can be derived.

Since the two input gates of the multiplier exhibit a high degree of symmetry due to the similar transistors 30, 31, 34, 35 and to similar resistors 32 and thus, overall, an equal source impedance of the first and second signal source, the multiplier described forms a highly linear precise analog mixer which can be used in wide-band phase/frequency demodulator circuits.

If the radio-frequency signal which can be supplied at input 37, 38 according to FIG. 7, is delivered by a logarithmic load, for example a diode load, the feedback resistor 9 in the emitter branches can be omitted.

The multiplier circuit according to FIG. 7 can be operated with supply voltages <3 V at a current consumption of <3 mA.

In the embodiment according to FIG. 7, the transistors 34, 35 operate as voltage followers and generate low-impedance voltage control junctions at their emitter points. The necessary no-load current of the voltage follower transistors 34, 35 is obtained from the currents, added together to form a constant current, of the common-mode current paths of the voltage/current converter differential amplifier of the second signal source.

At a noise figure NF of 20 dB, the multiplier circuit according to FIG. 7 supplies a gain of 6 dB. The $2^{nd}$ and $3^{rd}$ order input intercept points (IIP) are located at +65 dBm and 20 dBm, or greater, respectively.

Figure 8:
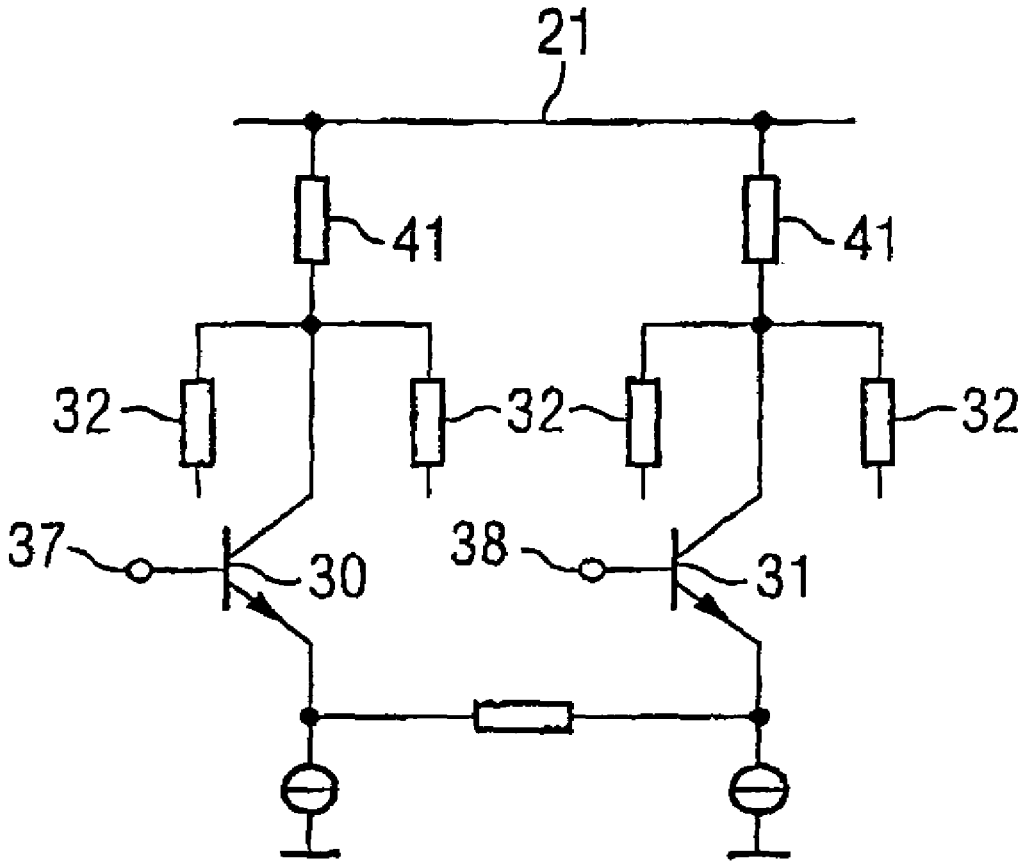
FIG. 8 shows a circuit for explaining the principle of voltage/current control of the first signal source according to FIG. 7.

Finally, FIG. 8 shows an alternative to the drive with transistors 34, 35 according to FIG. 7, the voltage drive of which has been replaced by a current drive according to FIG. 8. In this arrangement, the transistors 34, 35 of the first signal source of FIG. 7, which are connected as emitter followers, are replaced by a feedback-type differential amplifier. This differential amplifier has two bipolar transistors 30, 31, the collector terminals of which are connected via in each case one radio-frequency impedance 41 to the supply potential connection 21. In addition, the collector terminals are connected via in each case one resistor 32 as drawn in FIG. 7, to the four control inputs of the multiplier core 1. The base terminals of transistors 30, 31 can be supplied with a radio-frequency signal via the balanced input 37, 38. The emitter terminals of transistors 30, 31 are connected to one another via a feedback resistor 42 and to the reference potential connection 8 via in each case one current source 43.

What is claimed is:

1. A multiplier circuit, comprising:

a multiplier core with first and second cross-coupled transistor pairs, wherein each transistor comprises a control input and a controlled path and wherein the control inputs of the transistors of the first and second transistor pair form control inputs of the multiplier core;

a first signal source for receiving a first signal to be multiplied comprising:

an output;

an inverted complementary output; and a first impedance;

wherein the output of the first signal source is connected to the control input of the first transistor of the first transistor pair and to the control input of the second transistor of the first transistor pair, and wherein the inverted complementary output of the first signal source is connected to both the control inputs of the first and second transistor of the second transistor pair; and a second signal source for receiving a second signal to be multiplied comprising:

an output, an inverted complementary output; and a second impedance equal to the first impedance such that two electrically equivalent signal inputs are provided to the multiplier core;

wherein the output of the second signal source is connected to the control input of the first transistor of the first transistor pair and to the control input of the second transistor of the second transistor pair, and wherein the inverted complementary output of the second signal source is connected to the control input of the second transistor of the first transistor pair and to the first transistor of the second transistor pair.

2. The multiplier circuit as claimed in claim 1, wherein the transistor pairs each comprise first and second transistors having control inputs connected to respective control inputs of the multiplier core, and wherein the signal sources are cooperable with the multiplier core such that the first signal to be multiplied effectuates a diversion between the first transistor pair and the second transistor pair and the second signal to be multiplied effectuates a diversion between the first transistors and the second transistors of the respective transistor pairs.

3. The multiplier circuit as claimed in claim 2, wherein the first and second signal sources are for driving the multiplier core in such a manner that the control inputs of the first and second transistors of the first transistor pair are supplied with signals that are derived from the first and second signals to be multiplied, the control inputs of the first and second transistors of the second transistor pair are supplied with an inverted version of the first signal to be multiplied, the control inputs of the first transistors of the transistor pairs are supplied with the second signal to be multiplied, and the control inputs of the second transistors of the transistor pairs are supplied with an inverted version of the second signal to be multiplied.

4. The multiplier circuit as claimed in claim 3, wherein the first and second signal sources each comprise a differential amplifier having two inputs for receiving the associated signal to be multiplied and having four outputs connected to respective control inputs of the multiplier core.

5. The multiplier circuit as claimed in claim 2, wherein the first and second signal sources each comprise a differential amplifier having two inputs for receiving the associated signal to be multiplied and having four outputs connected to respective control inputs of the multiplier core.

6. The multiplier circuit as claimed in claim 1, wherein the first and second signal sources each comprise a differential amplifier having two inputs for receiving the associated signal to be multiplied and having four outputs connected to respective control inputs of the multiplier core.

7. The multiplier circuit as claimed in claim 6, wherein the differential amplifier of the first signal source is coupled to a supply potential and the differential amplifier of the second signal source is coupled to a reference potential.

8. The multiplier circuit as claimed in claim 7, wherein the transistor pairs each comprise first and second transistors having control inputs connected to respective control inputs of the multiplier core, and wherein the signal sources are cooperable with the multiplier core such that the first signal to be multiplied effectuates a diversion between the first transistor pair and the second transistor pair and the second signal to be multiplied effectuates a diversion between the first transistors and the second transistors of the respective transistor pairs.

9. The multiplier circuit as claimed in claim 8, wherein the first and second signal sources are for driving the multiplier core in such a manner that the control inputs of the first and second transistors of the first transistor pair are supplied with the first signal to be multiplied, the control inputs of the first and second transistors of the second transistor pair are supplied with an inverted version of the first signal to be multiplied, the control inputs of the first transistors of the transistor pairs are supplied with the second signal to be multiplied, and the control inputs of the second transistors of the transistor pairs are supplied with an inverted version of the second signal to be multiplied.

10. The multiplier circuit as claimed in claim 9, wherein the differential amplifiers each comprise four transistors having respective emitters connected to respective resistors.

11. The multiplier circuit as claimed in claim 8, wherein the differential amplifiers each comprise four transistors having respective emitters connected to respective resistors.

12. The multiplier circuit as claimed in claim 7, wherein the differential amplifiers each comprise four transistors having respective emitters connected to respective resistors.

13. The multiplier circuit as claimed in claim 6, wherein the differential amplifiers each comprise four transistors having respective emitters connected to respective resistors.

14. The multiplier circuit as claimed in claim 13, wherein the transistor pairs each comprise first and second transistors having control inputs connected to respective control inputs of the multiplier core, and wherein the signal sources are cooperable with the multiplier core such that the first signal to be multiplied effectuates a diversion between the first transistor pair and the second transistor pair and the second signal to be multiplied effectuates a diversion between the first transistors and the second transistors of the respective transistor pairs.

15. The multiplier circuit as claimed in claim 14, wherein the first and second signal sources are for driving the multiple core in such a manner that the control inputs of the first and second transistors of the first transistor pair are supplied with the first signal to be multiplied, the control inputs of the first and second transistors of the second transistor pair are supplied with an inverted version of the first signal to be multiplied, the control inputs of the first transistors of the transistor pairs are supplied with the second signal to be multiplied, and the control inputs of the second transistors of the transistor pairs are supplied with an inverted version of the second signal to be multiplied.

16. The multiplier circuit as claimed in claim 1, wherein the transistors of the transistor pairs are bipolar transistors.

17. The multiplier circuit as claimed in claim 16, wherein the bipolar transistors of each transistor pair have their emitters connected to one another to form the corresponding transistor pair.

18. The multiplier circuit as claimed in claim 17, wherein the bipolar transistors have respective base terminals connected to the control input of the multiplier core.

19. The multiplier circuit as claimed in claim 16, wherein the bipolar transistors have respective base terminals connected to the control input of the multiplier core.

20. The multiplier circuit as claimed in claim 1, wherein the first and second signal sources are voltage/current converters.

21. The multiplier circuit as claimed in claim 20, wherein the first and second signal sources each comprise a differential amplifier having two inputs for receiving the associated signal to be multiplied and having four outputs connected to respective control inputs of the multiplier core.

22. The multiplier circuit as claimed in claim 20, wherein the transistor pairs each comprise first and second transistors having control inputs connected to respective control inputs of the multiplier core, and wherein the signal sources are cooperable with the multiplier core such that the first signal to be multiplied effectuates a diversion between the first transistor pair and the second transistor pair and the second signal to be multiplied effectuates a diversion between the first transistors and the second transistors of the respective transistor pairs.

* * * * *